United States Patent [19]

Yoshida

[11] 4,182,006

[45] Jan. 8, 1980

[54] SLIDE FASTENER STRINGER

[75] Inventor: Hiroshi Yoshida, Uozu, Japan

[73] Assignee: Yoshida Kogyo Kabushiki Kaisha, Tokyo, Japan

[21] Appl. No.: 918,487

[22] Filed: Jun. 23, 1978

[30] Foreign Application Priority Data

Jul. 6, 1977 [JP] Japan ..... 52/89408[U]

[51] Int. Cl.[2] ..... A44B 19/00

[52] U.S. Cl. ..... 24/205.11 F; 24/205.16 C

[58] Field of Search ..... 24/205.11 F, 205 R, 24/205.16 R, 205.16 C

[56] References Cited

U.S. PATENT DOCUMENTS 3,333,305 8/1967 Taylor ..... 24/205.11 F
3,533,140 10/1970 Waldes ..... 24/205 R

FOREIGN PATENT DOCUMENTS 2065711 2/1975 Fed. Rep. of Germany ..... 24/205 R
36-19074 10/1961 Japan .
49-43745 4/1974 Japan .
948794 2/1964 United Kingdom .

*Primary Examiner*—Kenneth Dorner
*Attorney, Agent, or Firm*—Bucknam and Archer

[57] ABSTRACT

A slide fastener stringer comprises a stringer tape and a row of continuous meandering fastener elements fixed by sewing threads to one longitudinal edge of the tape, the elements being reinforced by a braid mounted on and extending along the element row. The slide fastener stringer has a cut edge where the tape, extreme one of the fastener elements, sewing threads, and braid, all including thermoplastic synthetic resin material, are fused together against raveling of the cut ends of the tape, sewing threads, and braid, and against sticking up of the element from the tape. The extreme fastener element has a pair of upper and lower legs one on each side of the tape, the legs being wrapped jointly by the sewing threads and stringer tape that are fused together and with the upper and lower legs. The braid is fused with portions of the sewing threads and stringer tape which extend beyond and around the extreme fastener element.

1 Claim, 6 Drawing Figures

SLIDE FASTENER STRINGER

BACKGROUND OF THE INVENTION

1. Field of the Invention

The present invention relates to a slide fastener stringer having a row of continuous fastener elements made of thermoplastic sythetic resin.

2. Prior Art

As is well known in the art, a row of filamentary fastener elements is attached to one longitudinal edge of an elongate sliding clasp fastener stringer by means of sewing threads. Such elongate fastener stringer is cut off into desired lengths each having an element-free gap through which a slider is to be assembled.

The stringer tape is prone to become raveled where it has been severed conventionally by a cutter, and sewing threads which are broken by the cutter near the element-free gap allow fastener elements to loosen and come off. This had led to a drawback in that a slider cannot easily be attached, and the loosened fastener elements can prevent top and bottom end stops from being applied thereto at precise locations.

Various attempts have been made to eliminate the problems. One such effort is a plastic film bonded around the cut edges of the tape and fastener elements. It has also been proposed to impregnate the stringer tape with a synthetic resin solution, or to fuse thermoplastic material in the fastener components at the cut edges. Such prior procedures, however, are disadvantageous in that extra process steps are involved and in that the fastener elements once loosened cannot be properly restored to the fixed position. Furthermore, since the fastener stringer is cut substantially at a right angle to its plane, the thermoplastic material tends to create sharp cut edges which are injurious to the skin or the garments.

SUMMARY OF THE INVENTION

According to the present invention, an extreme fastener element of the zigzag type adjacent to a cut edge of a slide fastener stringer has an upper leg on one side of the stringer tape and a lower leg on the other tape side, the upper and lower legs being wrapped jointly by sewing threads and the stringer tape that are fused together and with the upper and lower legs. A reinforcing braid mounted on the lower legs of the elements is fused with portions of the sewing threads and stringer tape which extend beyond and around the extreme fastener element. The reinforcing braid may extend around the extreme fastener element in coalescing relation with the tape and sewing threads.

An object of the present invention is to provide a slide fastener stringer having fastener elements positionally stabilized at the cut edge portions of the stringer against loosening therefrom.

Another object of the present invention is to provide a slide fastener stringer with its tape fabric and sewing threads held against raveling at the cut edges of the stringer.

Still another object of the present invention is to provide a pair of slide fastener stringers to which a slider, a top and a bottom end stop can be attached easily and precisely.

A further object of the present invention is to provide a slide fastener stringer having raveling-free and stabilized cut edges that can be formed simultaneously with an operation in which the fastener stringer is cut off and is provided with element-free gaps.

The above and other objects and advantages of the present invention will become apparent from the following detailed description when taken in conjunction with the accompanying drawings.

DETAILED DESCRIPTION

Figure 1:
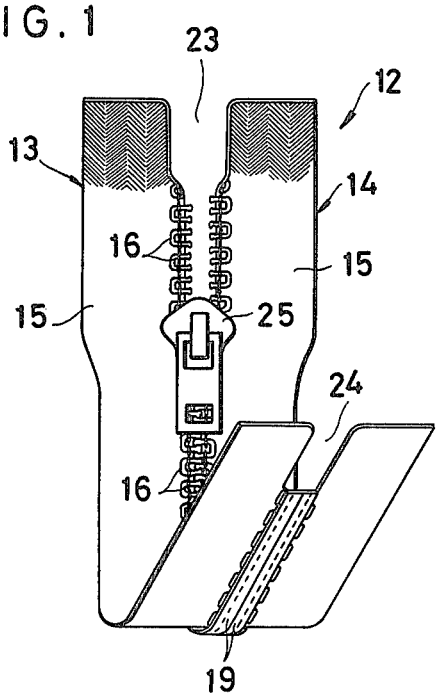
FIG. 1 is a plan view, with a portion shown reversed, of a pair of fastener stringers constructed according to the invention, the stringers carrying a slider thereon.

As shown in FIG. 1, a slide fastener 12 comprises a pair of fastener stringers 13,14 each including a stringer tape 15 and a row of continuous fastener elements 16 of the meandering or zigzag type mounted on and along one longitudinal edge of the tape 15. The stringer tape 15 is of a woven or knitted structure including yarns of naturally occurring fibers blended with thermoplastic synthetic resin fibers, or solely of synthetic resin fibers. The tape 15 may alternatively be of a union fabric including naturally occurring fibers and thermoplastic synthetic resin fibers.

Each fastener element 16 includes a pair of upper and lower legs 17,18 (FIG. 2), the fastener elements 16 being disposed astride the stringer tape 15 with their upper and lower legs 17,18 respectively on the opposite surfaces of the tape 15. An elongate reinforcing member 19 such as a braid extending along the row of fastener elements 16 and disposed on one side of the lower legs 18 of the elements 16 which is remote from the stringer tape 15, the braid 19 including thermoplastic synthetic resin fibers.

Figure 2:
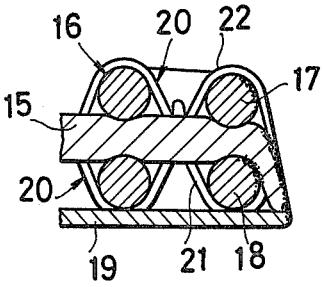
FIG. 2 is an enlarged cross-sectional view of a cut edge portion of one of the stringers shown in FIG. 1.

As better illustrated in FIG. 2, the row of fastener elements 16 and the braid 19 are fixed to the stringer tape 15 by means of sewing threads 20 such as of double locked stitch that is composed of needle threads 21 and looper threads 22. The needle threads 21 penetrate the braid 19 and extend around the lower element legs 18, and the looper threads 22 surround the upper element legs 17, thereby holding the fastener elements 16 in position on the stringer tape 15. The sewing threads 20 include or may be formed solely with thermoplastic synthetic resin fibers.

The pair of fasteners stringer 13,14 with the element rows intermeshed is cut off from a continuous elongate blank of paired stringers (not shown), and at the same time are provided with an upper element-free gap or space 23 in its upper end portion and a lower element-free gap or space 24 in its lower end portion, the element-free gaps 23,24 being formed typically by stamping out the stringers 13,14. The cutting and stamping-out operation on the fastener stringers 13,14 is carried out by means of a punch (not shown) with heat generated as by a high-frequency or an ultrasonic welder, or an electric heater, so as to enable the cut edges and ends of the tapes 15,15, fastener elements 16, sewing threads 20, and braid 19 to be melted and fused simultaneously with the cutting and stamping-out operation, the cut edges and ends on solidification preventing raveling of the tape fabric yarns, sewing threads and braid yarns, and sticking up of the fastener elements 16 from the stringer tapes 15,15.

FIG. 2 also shows a cut end of the row of fastener elements 16, in which the upper leg 17 of an extreme fastener element is wrapped by the stringer tape 15 and the looper threads 22 which are fused with the element and extend toward the braid 19 under tension in coalescing relation with the tape 15. The lower leg 18 of the extreme fastener element is wrapped by the braid 19, the needle threads 21 and the stringer tape 15 which is fused with the element, and extends toward and is fused at its distal end with the braid 19. Accordingly, the extreme fastener element 16 at the cut edge is held stably in position on the stringer tape 15 against loosening therefrom. Furthermore, the sewing threads 20, stringer tape 15, and braid 19 are united together at the cut end and are prevented from fraying, thereby giving such cut end a neat and smooth appearance.

Figure 3:
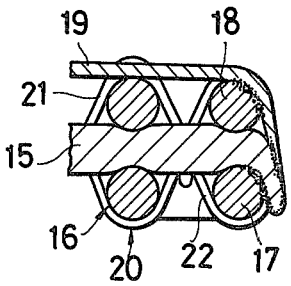
FIG. 3 is a view similar to FIG. 2, showing a cut edge portion of a modified stringer.

According to a modified structure shown in FIG. 3, the stringer 13(14) is turned upside down, and the lower leg 18 of the extreme fastener element at the cut edge is covered by the stringer tape 15, needle threads 21, and braid 19 which is fused with the lower leg 18 and extends therearound toward the upper leg 17. The stringer tape 15 which extends in coalescing relation around the upper leg 17 away from the lower leg 18, is fused with the braid 19, the upper leg 17 being enclosed by the stringer tape 15 and the looper threads 22.

Figure 4:
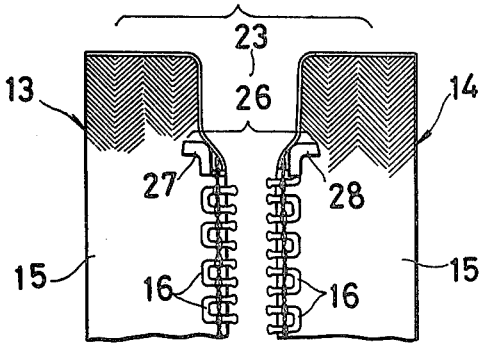
FIG. 4 is a fragmentary plan view of a portion of the stringers to which a top end stop is applied.
Figure 5:
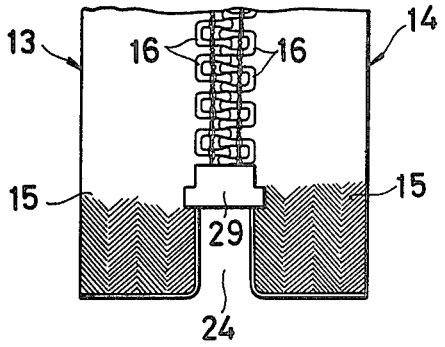
FIG. 5 is a fragmentary plan view of a portion of the stringers having a bottom end stop attached thereto.

A slider 25 (FIG. 1) is furnished onto the pair of fastener stringer 13,14, through the upper element-free gap 23 bounded by the neatly finished cut edges of the stringers 13,14. As shown in FIGS. 4 and 5, a top end stop 26 including a pair of stop halves 27,28 and a bottom end stop 29, both made of synthetic resin, are molded on the upper and lower end portions, respectively, adjacent to the upper and lower element-free gaps 23,24 of the stringers 13,14, thereby confining the slider 25 to movement along the rows of fastener elements 16 between the top end stop 26 and the bottom end stop 29.

Figure 6:
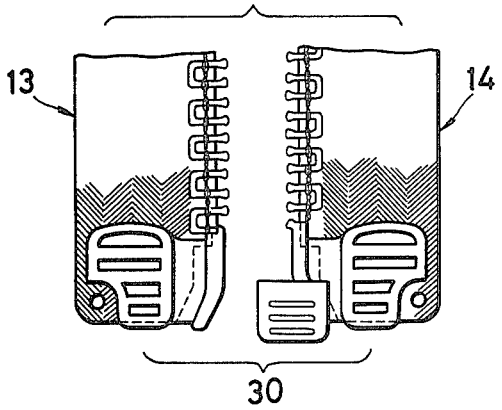
FIG. 6 is a fragmentary plan view of a portion of the stringers with a separable bottom end stop mounted thereon.

FIG. 6 illustrates a separable bottom end stop 30 formed by molding plastics material on the lower end portion of the stringers 13,14.

It should be understood that the specific forms of the invention herein shown and described are intended to be illustrative only, as certain changes may be made therein without departing from the scope of the appended claims.

What is claimed is:

1. A slide fastener stringer comprising:

(a) a stringer tape including thermoplastic synthetic fibers;

(b) a row of continuous fastener elements made of thermoplastic synthetic resin and mounted on and along one longitudinal edge of said stringer tape;

(c) reinforcing means extending along said row of continuous fastener elements and including thermoplastic synthetic fibers; and (d) sewing threads fixing said fastener elements and said reinforcing means to said stringer tape, said sewing threads including thermoplastic synthetic fibers, and there being a cut edge in which said stringer tape, one of said fastener elements, said reinforcing means, and said sewing threads are fused together, and said sewing threads and said stringer tape jointly wrapping and retaining said one fastener element at said cut edge, said reinforcing means comprising a braid mounted on one side of said continuous fastener elements which is remote from said stringer tape, said braid covering and retaining said one element at said cut edge.

* * * * *